US006684573B2

(12) United States Patent
Heath et al.

(10) Patent No.: US 6,684,573 B2
(45) Date of Patent: Feb. 3, 2004

(54) ELEVATOR DOOR SILL ASSEMBLY

(75) Inventors: Ernest A. Heath, Olive Branch, MS (US); Eugene C. Ulm, Collierville, TN (US)

(73) Assignee: Thyssen Elevator Capital Corp., Whittier, CA (US)

( * ) Notice: Subject to any disclaimer, the term of this patent is extended or adjusted under 35 U.S.C. 154(b) by 0 days.

(21) Appl. No.: 09/848,907

(22) Filed: May 4, 2001

(65) Prior Publication Data

US 2003/0033754 A1 Feb. 20, 2003

(51) Int. Cl.[7] ..... E06B 1/70
(52) U.S. Cl. ..... 49/467; 49/411; 187/334
(58) Field of Search ..... 49/467, 409, 410–411, 49/366, 370, 118, 120; 16/96 R, 96 D, 91, 90; 187/334

(56) References Cited

U.S. PATENT DOCUMENTS

| | | | | | |
|---|---|---|---|---|---|
| 1,468,019 | A | * | 9/1923 | Guerrant | 16/93 R |
| 3,052,930 | A | * | 9/1962 | Mathews | 16/93 R |
| 3,384,998 | A | * | 5/1968 | Abramson | 16/90 |
| 3,426,480 | A | * | 2/1969 | Dzamba | 187/333 |
| 3,903,647 | A | * | 9/1975 | Hubbard et al. | 200/61.43 |
| 4,258,443 | A | * | 3/1981 | Baus | 16/90 |
| 4,769,949 | A | * | 9/1988 | Glendowne | 16/90 |
| 4,781,270 | A | * | 11/1988 | Holland | 187/313 |
| 5,121,817 | A | * | 6/1992 | Garrido et al. | 187/313 |
| 5,293,962 | A | * | 3/1994 | Pelvilain | 187/333 |
| 5,305,855 | A | * | 4/1994 | Rivera et al. | 187/334 |
| 5,706,913 | A | * | 1/1998 | Rivera | 187/334 |
| 5,715,913 | A | * | 2/1998 | De Jong | 187/334 |

FOREIGN PATENT DOCUMENTS

| | | |
|---|---|---|
| JP | 03-232683 | 10/1991 |

* cited by examiner

*Primary Examiner*—Daniel P. Stodola
*Assistant Examiner*—Khoa Tran
(74) *Attorney, Agent, or Firm*—White & Case LLP

(57) ABSTRACT

An elevator door sill assembly for use in elevator systems that have sliding doors. The door sill assembly comprises a sill plate, a support sill located below the sill plate having a rail that presents an inboard sliding surface and an outboard sliding surface. The assembly also comprises a first guiding surface that engages that inboard sliding surface and a second guiding surface that engages the outboard sliding surface. The assembly prevents that bottom of the elevator door from swinging while the door slides opened and closed. The sill assembly and guide system may be used with either hoistway doors or elevator car doors.

5 Claims, 7 Drawing Sheets

ELEVATOR DOOR SILL ASSEMBLY

FIELD OF THE INVENTION

The present invention relates to elevator systems that employ sliding doors that are suspended above a door sill. In particular, the invention provides a door sill assembly for guiding the lower portion of one or more sliding elevator doors without the need for a slot in the door sill. Such slots typically accumulate debris and which often requires the use of a guide having a shape complementary to the slot. The present invention may be used with either hoistway doors or elevator car doors.

DESCRIPTION OF RELATED ART

A typical elevator system employs sliding hoistway doors and sliding car doors that are suspended from overhead rails. In order to prevent the bottom of the doors from swinging into or away from the hoistway (or into and out of the elevator car), while at the same time allowing the doors to slide between an opened and closed position, one or more door guides are fastened to a lower portion of the door. Traditionally, door guide(s) ride in a upward facing slot that is located in a door sill. The guides have a shape complementary to the shape of the slot. This allows the door guide to slide along the slot but prevents the bottom of the door from swinging in a direction perpendicular to the sliding motion of the door.

Litter and debris often fall into the upward facing slot and impede proper operation of the door. To address this problem, at least with respect to sliding elevator car doors, some manufacturers have placed the slot under the floor of the elevator car or in the side of a car sill. While these designs are intended to reduce the amount of litter that accumulates in the slot, in some applications, litter can still find its way into the slot and cause maintenance problems. Moreover, these designs require the use of a door guide having a shape that is complementary to the shape of the slot (or at least complementary to a portion of the slot). The guide must also be small enough to fit in the slot. Yet if the guide is made too much smaller than the slot, the bottom of the door will be able to swing in and out and this swinging could, under some circumstances, cause the door to bind or otherwise prevent the door from operating properly.

SUMMARY OF THE INVENTION

The present invention provides a door sill assembly for guiding a lower portion of a sliding elevator door in a standard elevator system. The sliding door has a door surface and slides horizontally in a direction parallel to the door surface. The sliding door may be a hoistway door or a car door.

In one embodiment of the invention, a sill plate is installed horizontally in the threshold of a hoistway opening. The sill plate is preferably mounted below the sliding door and in a direction that is parallel to the door surface. A horizontal rail is mounted under the sill plate in a direction approximately parallel to the door surface. The rail may be mounted on the sill support assembly on which the sill plate may be mounted, or the rail may be an integral part of the sill plate. The rail preferably has first and second sliding surfaces. A pair of door guide surfaces, i.e., a first and second door guide surface, straddle the rail so that the rail is located between the sliding surfaces. The first door guide surface engages and can slide along the first sliding surface and the second door guide surface engages and can slide along the second sliding surface. Thus, the guides surfaces can slide along the rail, but cannot move perpendiculary toward and away from the rail.

The guide surfaces may be connected to a bracket, which in turn may be fastened, either directly or indirectly, to a lower portion of the door. The door is thus free to slide along the rail, but door is restricted from moving toward and away from the sliding surfaces and consequently toward and away from the hoistway. In one embodiment, the sliding surfaces are preferably vertical surfaces and are preferably parallel to the door surface. The sliding surfaces may, however, be oriented in any direction that allows door to slide opened and closed but restricts the bottom of the door from swinging toward and away the hoistway.

The present invention also employs a safety that prevents the sliding door(s) from moving in a direction perpendicular to the door surface in the event the door guide surfaces, brackets or other components fail. The safety has first and second safety surfaces that are capable of engaging the first and second sliding surfaces of the rail in the event a primary door guidance system, such as the one described herein, fails. Because the safety does not ordinarily engage the rail, it may be manufactured from materials that are not necessarily suitable for use as door guide surfaces. Typically, but not necessarily, the safety surface would engage the appropriate sliding surface to prevent the door from swinging away from the door sill assembly.

The present invention also provides a telescopic sliding door assembly comprising an fast-speed door and a slow-speed door. The fast-speed door has a door surface that faces some or all of the slow-speed door. This assembly may be a two-speed arrangement. The fast-speed door may employ the above-described door sill assembly as a guidance means. The slow-speed door, which moves preferably at approximately half the speed of the fast-speed door, is guided as follows. A downwardly-facing dual track assembly is horizontally mounted on the slow-speed door. It is preferably mounted on a lower portion of the door surface, which faces the fast-speed door. The dual track assembly preferably has two parallel horizontal channels that face downward, i.e. the opening in the channel faces downward. The first channel slides over and is guided by a stationary slow-speed door guide that is mounted to and extends vertically upward from the sill plate or the floor surface. The second channel rides over and is guided by a moving slow-speed door guide that is mounted on a lower portion of the fast-speed door with a bracket. As the fast-speed door moves so does the moving slow-speed door guide. Accordingly, as the slow-speed door moves, it is guided by the stationary slow-speed door guide and by the moving door guide.

DETAILED DESCRIPTION OF THE INVENTION

Figure 1:
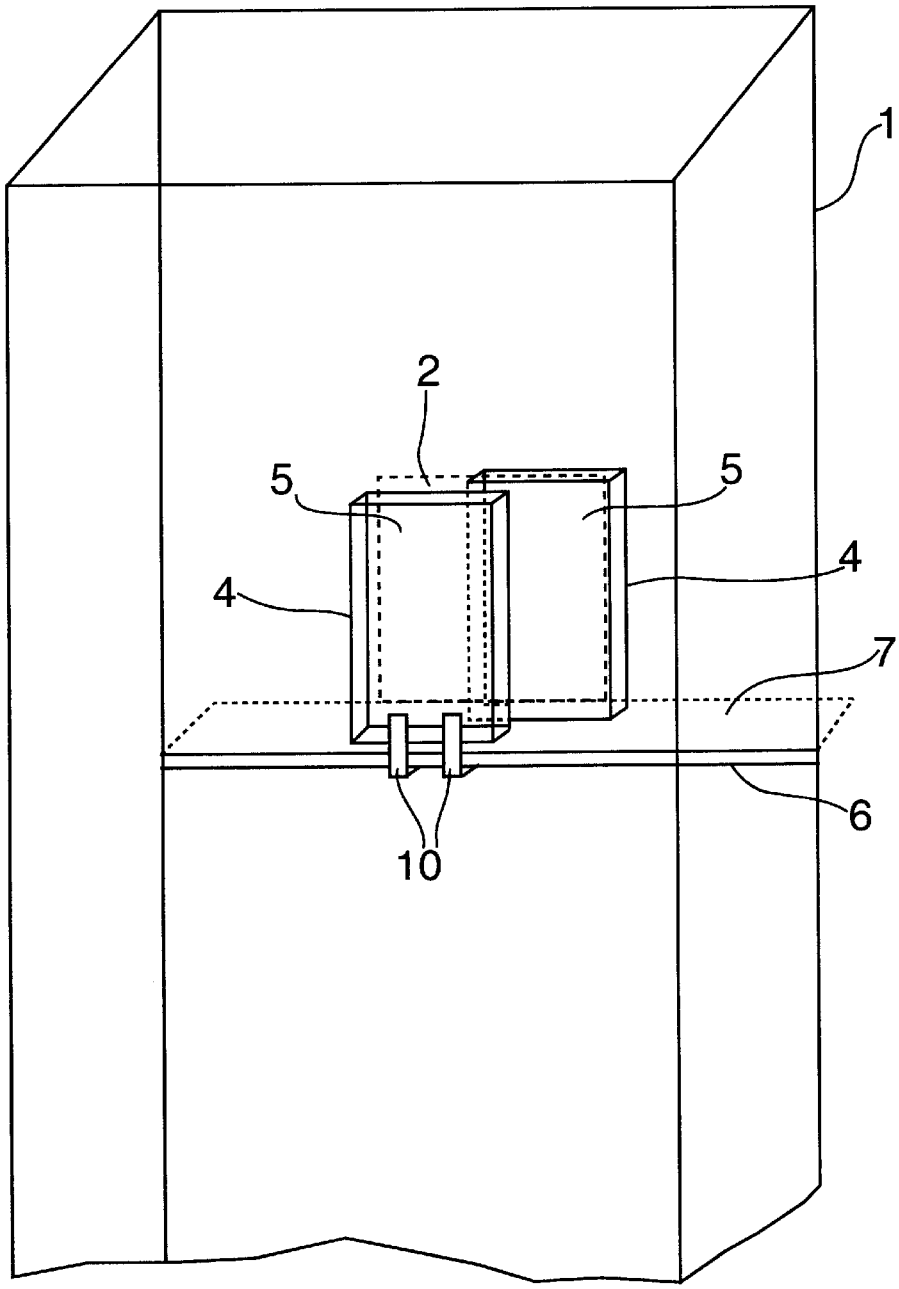
FIG. 1 is a perspective view of an elevator system that employs the door sill assembly of present invention, viewed from the back side of the elevator shaft.

As is shown in FIG. 1, an elevator system comprises an elevator car (not shown) that travels in an elevator hoistway 1. The hoistway 1 has an opening 2. One or more sliding hoistway doors 4 that are suspended from above in front of the opening 2. The sliding hoistway doors 4 have door surface(s) 5. Each sliding hoistway door 4 slides horizontally in a direction parallel to the door surface 5. In one embodiment, a sill plate 6 having an upward facing surface 7 is located below the sliding hoistway door(s) 4 and is oriented so that it is horizontal and parallel to the door surface(s) 5. A lower portion of each sliding door is connected to one or more brackets 10 that extend below the sill plate 6.

Figure 2:
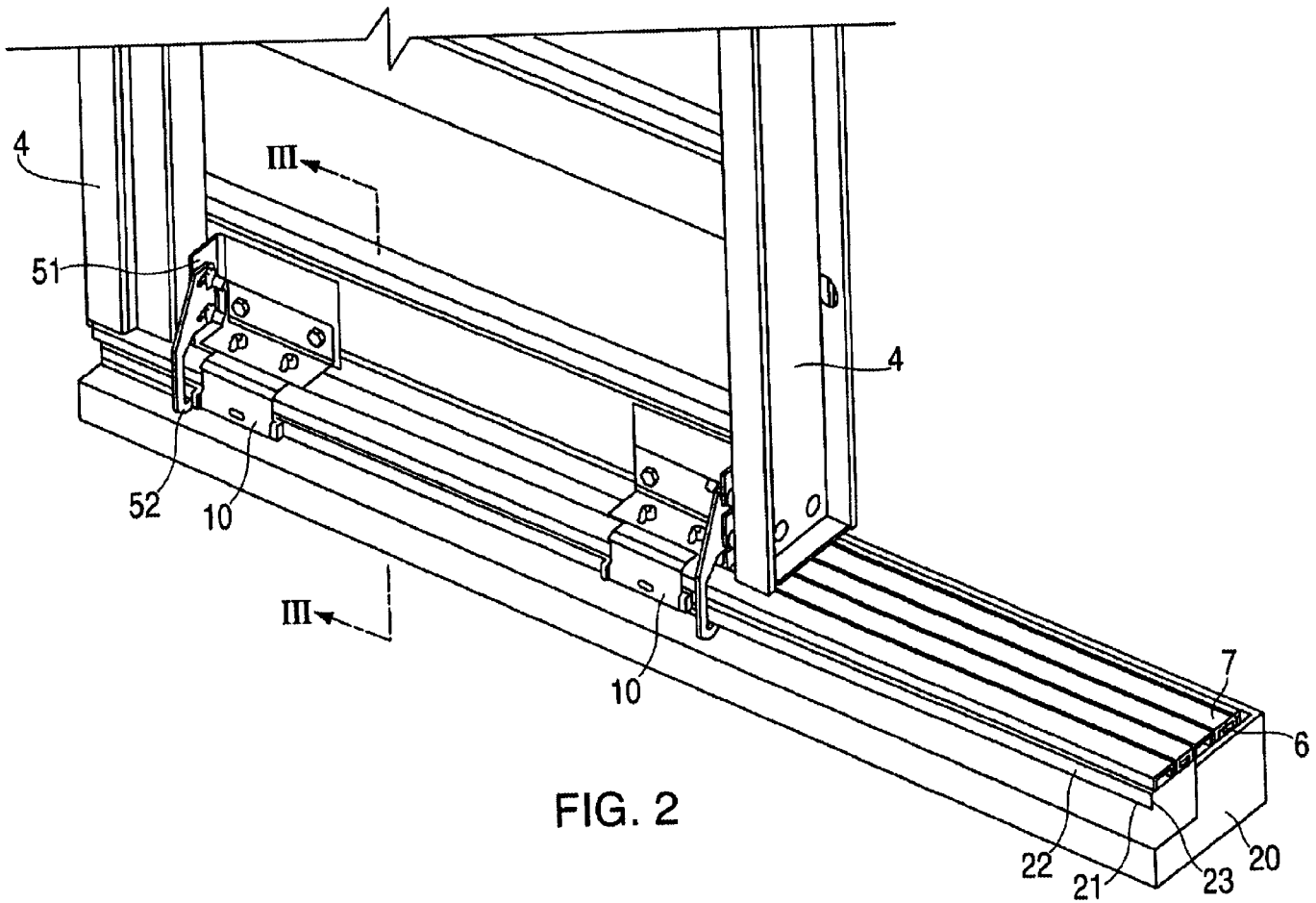
FIG. 2 is a perspective view of one embodiment of the door sill assembly of the present invention.
Figure 3:
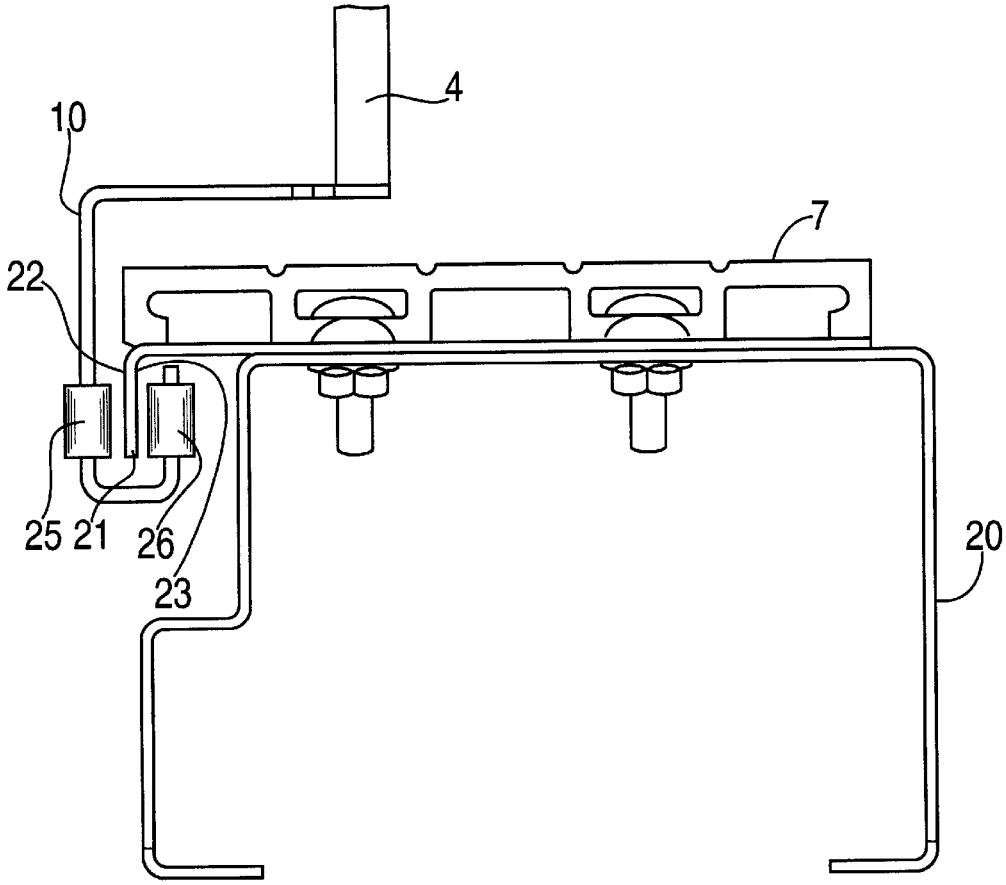
FIG. 3 is a portional cross-sectional view of the door sill assembly taken along lines III—III of FIG. 2.
Figure 4:
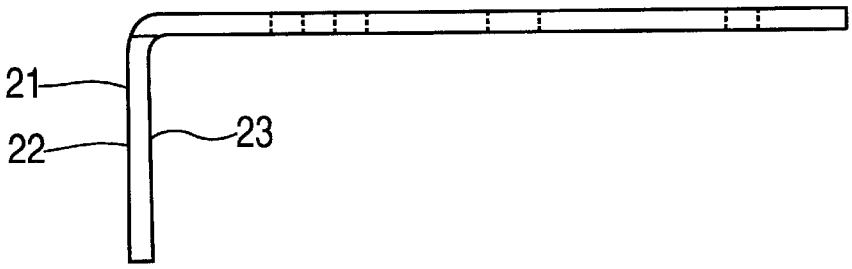
FIG. 4 is an enlarged cross-sectional view of the rail 21 shown in FIG. 3.

FIGS. 2 and 3 show the door sill assembly of the invention employed to guide a hoistway sliding door. The assembly may also be used to guide the movement of an elevator car door. As is shown in FIGS. 2 and 3, a sill support assembly 20 having a rail 21 is located below the sill plate 6. The rail 21 has a first sliding surface 22 and a second sliding surface 23. (See FIGS. 3 and 4). The first and second sliding surfaces 22, 23 are preferably, but not necessarily, vertical surfaces. While a rectangular rail is depicted, other shaped rails may be used. For example, the rail may have a triangular cross-section with its apex located at its lowest point. In some embodiments, the rail may be circular or semicircular. For example, a tube or portion of a tube may be used as a rail.

As is shown in FIG. 3, a first guide surface 25 and a second guide surface 26 straddle the rail 21. The first and second guide surfaces 25, 26 are preferably made from low friction materials, for example Delrin.® The first guide surface 25 may engage the first sliding surface 22 and the second guide surface 26 may engage the second sliding surface 23. The first sliding surface 22 restricts the first guide surface 25 from substantially moving away from the hoistway and the second sliding surface 23 restricts the second guide surface from substantially moving toward and into the hoistway. Thus, when the guide surfaces 25, 26 are connected to the sliding door 4 by a bracket 10, the guide surfaces 25, 26 and the door 4 are free to move in a direction parallel to the rail 21 (i.e., into and out of the plane of FIG. 2). However, the guide surfaces 25, 26 and door 4 are restricted from moving in a direction perpendicular to the rail 21. In some embodiments, the first and second guide surfaces 25, 26 may continuously engage and slide along the rail 21; in other embodiments, clearance between the rail 21 and the guide surfaces 25, 26 is provided so that the guides do not engage the rail unless the door 4 swings in a direction perpendicular to the door surface 5. The degree to which the swinging motion of the door is restricted will be a function of the clearance between the guide surfaces 25, 26 and the sliding surfaces 22, 23.

Figure 6:
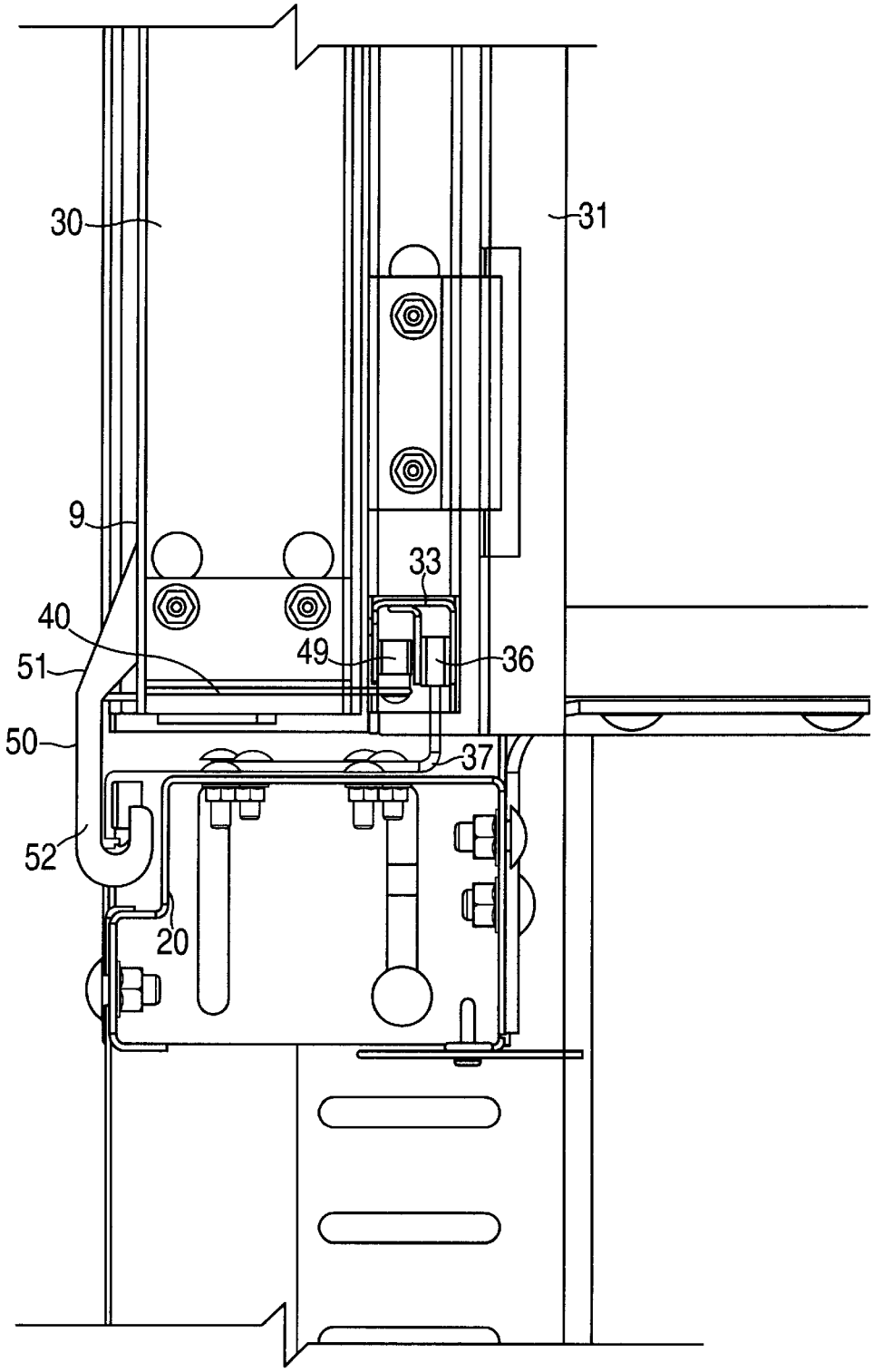
FIG. 6 is a cross-sectional view of a door sill assembly with a safety device taken along lines VI—VI of FIG. 5.

A safety may be employed with the present invention to prevent the sliding door from swinging in the event that a component in the door sill assembly fails. As is shown in FIGS. 2 and 6, the safety comprises a bracket portion 51 that is fastened to the lower portion of the door 4 and contains one or more safety surfaces 52 for engaging the first sliding surface, second sliding surface, or both when the sliding door swings in a direction perpendicular to the rail. Under normal operation, the safety surfaces 52 do not engage the rail, but in the event that sufficient force is applied to the door to cause it to swing and to cause a primary door guiding mechanism to fail, the safety surfaces would engage the rail and restrict the door's ability to swing.

Figure 5:
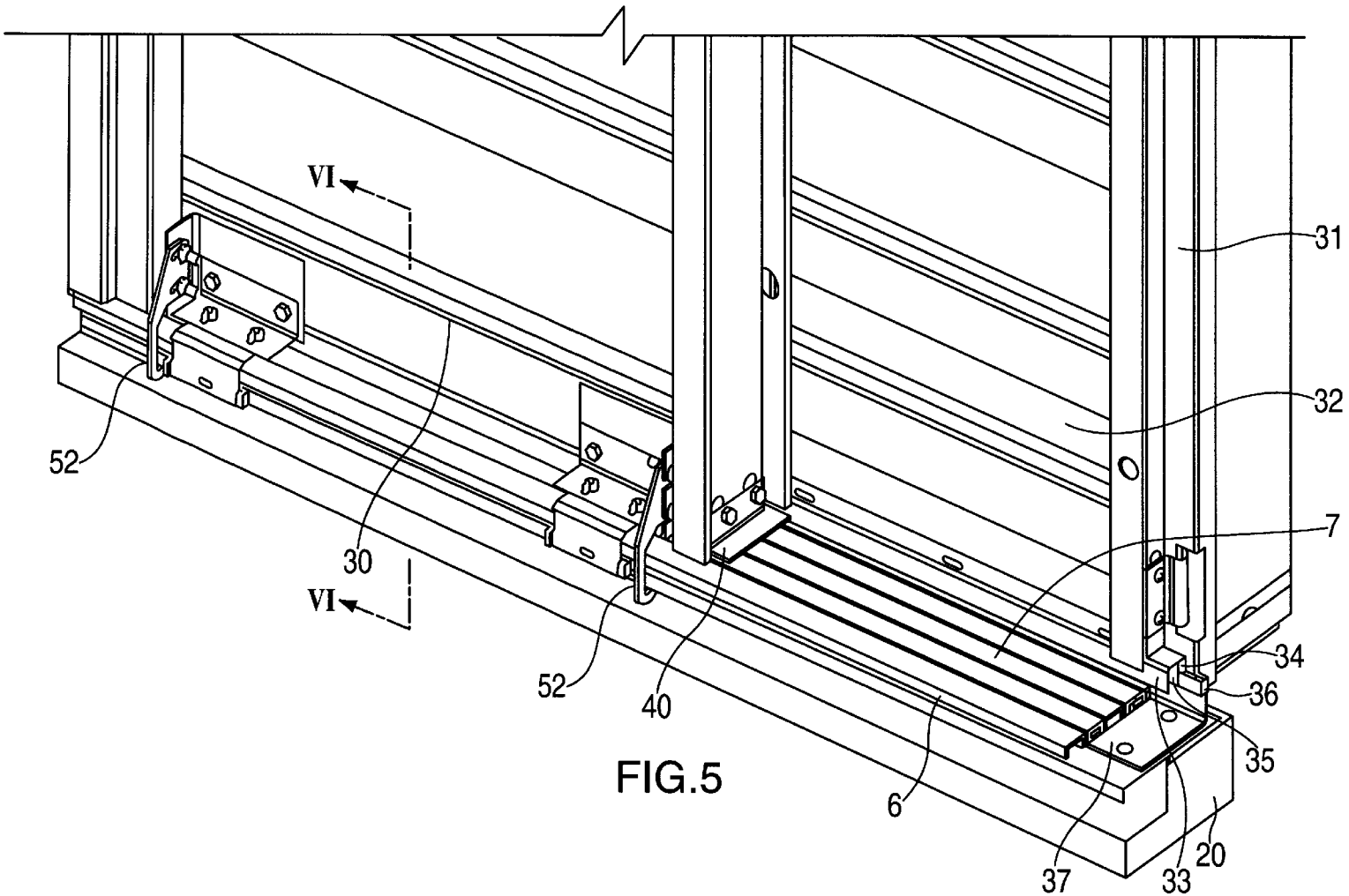
FIG. 5 is a perspective view of a telescopic elevator door system that employs one embodiment of the present invention.
Figure 7:
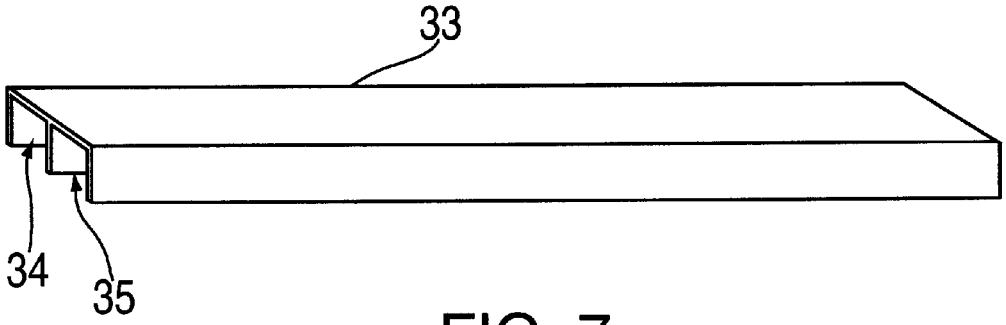
FIG. 7 is a perspective view of a dual track assembly.
Figure 8:
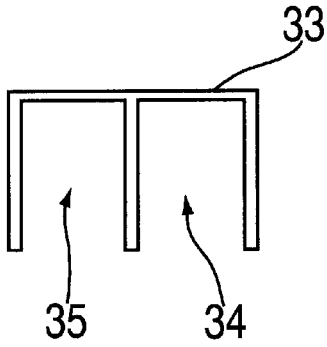
FIG. 8 is a cross-sectional view of the dual track assembly.
Figure 9:
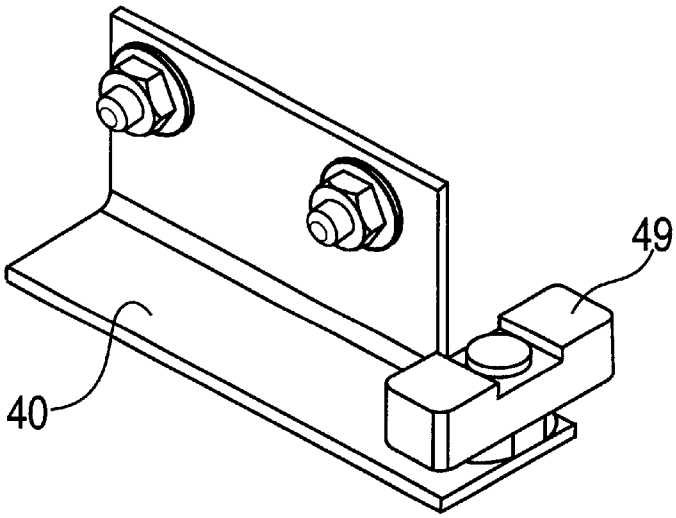
FIG. 9 is a perspective view of a moving slow-speed door guide and bracket used to attach that guide to the fast-speed door.
Figure 10:
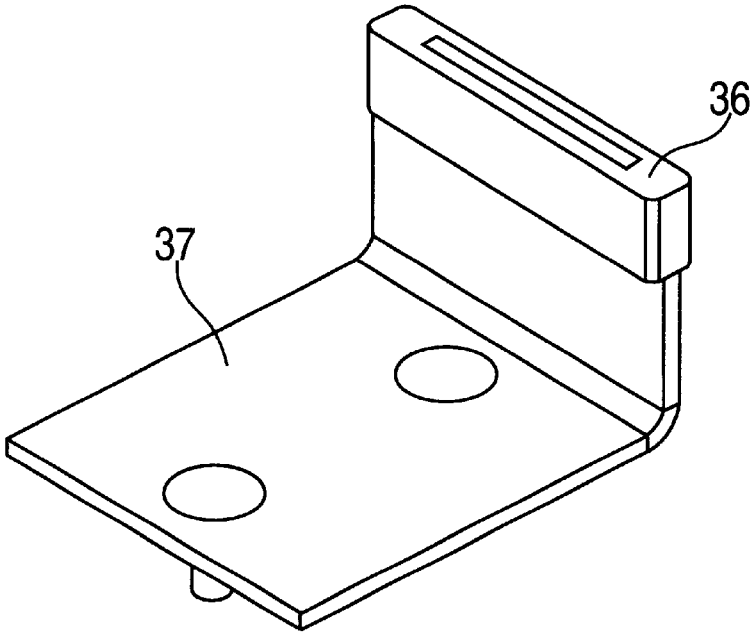
FIG. 10 is a perspective view of a stationary slow-speed door guide and a bracket used to attach that guide to the sill or floor surface.

The door sill assembly of the present invention may be used with an elevator system that employs a two-speed sliding telescopic door arrangement. FIG. 5 shows a telescopic door system that may be used in conjunction with the door sill assembly of the present invention. An fast-speed door 30 is suspended from above and has a lower section that is guided by the sill assembly of the present invention in the same manner that is described above. A slow-speed door 31, which moves slower than and preferably about half the speed of the fast-speed door, is also provided and both doors are suspended above the sill plate 6, which is mounted to a sill support assembly 20. In FIG. 5, the doors are shown in their closed position and slide horizontally to the right to open. The slow-speed door 31 is parallel to the fast-speed door 30 and has a door surface that faces at least a portion of the fast-speed door. When both doors are open, the door surfaces may face substantially the entire fast-speed door. A dual track assembly 33 is mounted near the bottom of the slow-speed facing surface 32. The dual track assembly 33 has first and second downwardly facing channels 34 and 35. (See also FIGS. 7 and 8). A stationary slow-speed door guide 36 is fastened with a bracket 37 to the support sill assembly 20 near the right edge of the slow-speed door, when the doors are in their closed position. (See FIGS. 5, 6, and 10). The slow-speed door guide 36 engages the first channel 34. When the slow-speed door 31 opens by moving to the right, the first channel 34 slides along and is guided by the stationary slow-speed door guide 36. The dual track assembly 33 is restricted from moving in a direction perpendicular to the door surface 32. A moving slow-speed door guide 49 is mounted to the second door bracket 40. (See FIGS. 5, 6 and 9). The moving slow-speed door guide 49 rides in the second channel 35. The moving slow-speed door guide 49 is free to travel in direction parallel to the dual track assembly 33 but is restricted from moving in a direction perpendicular to the dual track assembly 33. Accordingly, the slow-speed door 31 is restricted from moving in a direction perpendicular to the dual track assembly 33 which is parallel to the slow-speed door surface 32.

Those skilled in the art will recognize that, although the invention has been described with reference to a sill plate and/or sill support assembly, these elements are not required in every embodiment. In some embodiments, the support sill may be mounted below or adjacent to a floor surface that is located below the sliding doors; thus eliminating the need for a sill plate. When the present invention is used with sliding elevator car doors, the support sill and/or sill plate may be dispensed with and the rail mounted either directly below the elevator car floor or mounted on a suitable structure that is mounted below the elevator car floor.

What is claimed is:

1. A telescopic elevator door assembly comprising:

a first door having a lower portion;

a second door having a door surface that faces at least a portion of the first door;

a sill that is located beneath the first and second doors and generally parallel to the first and second dooms;

a rail located beneath the sill, the rail having a first sliding surface and a second sliding surface;

a first guide surface that slides along the first sliding surface;

a second guide surface that slides along the second sliding surface;

at least one bracket connecting the first and second guide surfaces to the lower portion of the first door;

a stationary door guide for guiding the second door, the stationary door guide mounted to an upper surface on the sill;

a moving door guide mounted by a bracket to the lower portion of the first door, and a dual track assembly that is horizontally mounted on the door surface of the second door, the dual track assembly having a first and second downward facing channels, the first channel straddling the stationary door guide, the second channel straddling the moving door guide.

2. The telescopic elevator door assembly of claim 1 wherein the rail is part of a support sill assembly.

3. The telescopic elevator door assembly of claim 1 wherein the elevator doors are elevator hoistway doors.

4. The telescopic elevator door assembly of claim 1 wherein the elevator doors are elevator car doors.

5. The telescopic elevator door assembly of claim 1, wherein the rail is located between the first guide surface and the second guide surface.

* * * * *